US007422405B2

(12) United States Patent
Blumberg et al.

(10) Patent No.: US 7,422,405 B2
(45) Date of Patent: Sep. 9, 2008

(54) BINDING OF A SHEET OF PAPER

(75) Inventors: Murray Basil Blumberg, Gauteng Province (ZA); Eric Rodney DeBeer, Gauteng Province (ZA)

(73) Assignee: Press Products (Proprietary) Limited, Johannesburg, Gauteng Province (ZA)

( * ) Notice: Subject to any disclaimer, the term of this patent is extended or adjusted under 35 U.S.C. 154(b) by 551 days.

(21) Appl. No.: 10/765,265

(22) Filed: Jan. 27, 2004

(65) Prior Publication Data

US 2005/0029730 A1 Feb. 10, 2005

(30) Foreign Application Priority Data

Mar. 31, 2003 (ZA) ..... 2003/2509

(51) Int. Cl.
*B42C 11/00* (2006.01)

(52) U.S. Cl. ..... 412/6; 412/33; 283/2

(58) Field of Classification Search ..... 412/6, 412/8, 33, 37, 901; 281/21.1; 283/2
See application file for complete search history.

(56) References Cited

U.S. PATENT DOCUMENTS

| | | | | |
|---|---|---|---|---|
| 1,057,295 | A | 3/1913 | Stuebing, Sr. | |
| 1,906,024 | A | 4/1933 | Todd | |
| 2,042,912 | A | 6/1936 | Stuebing, Jr. | |
| 2,050,241 | A | 8/1936 | Becker | |
| 2,387,808 | A * | 10/1945 | Pruneau et al. | 281/21.1 |
| 2,690,781 | A | 10/1954 | Hall | |
| 2,749,961 | A | 6/1956 | Czarnik | |
| 2,774,161 | A * | 12/1956 | Dixon | 40/107 |
| 2,912,038 | A | 11/1959 | Harper | |
| 3,659,330 | A | 5/1972 | De Villier et al. | |
| 3,826,227 | A | 7/1974 | Allison | |
| 3,946,919 | A | 3/1976 | Ernst | |
| 4,130,933 | A | 12/1978 | Demrick | |
| 4,151,037 | A | 4/1979 | Klingelhoefer et al. | |
| 4,208,750 | A | 6/1980 | Pfaffle | |
| 4,365,492 | A | 12/1982 | Kortan et al. | |
| 5,364,215 | A | 11/1994 | Snellman et al. | |
| 5,496,253 | A | 3/1996 | Snellman et al. | |
| 5,599,045 | A | 2/1997 | Asai et al. | |
| 5,707,194 | A | 1/1998 | Blumberg et al. | |

(Continued)

FOREIGN PATENT DOCUMENTS

| | | |
|---|---|---|
| JP | 2000351288 | 12/2000 |

*Primary Examiner*—David P. Bryant
*Assistant Examiner*—Eric A Gates
(74) *Attorney, Agent, or Firm*—Wood, Herron & Evans, LLP

(57) ABSTRACT

This invention relates to a method of binding a sheet of paper. The method includes the steps of feeding an end of a sheet of paper to be bound into a partially folded elongate binding strip which defines a longitudinal axis and has two portions angularly disposed to each other, the end of the sheet of paper being fed in a feed direction that is parallel to the longitudinal axis of the binding strip into a region between the two portions and mating the end of the sheet of paper and the binding strip, with the end of the sheet of paper located in the region between the two portions. The method also relates to an apparatus for binding a sheet of paper, according to the method of the invention.

23 Claims, 3 Drawing Sheets

U.S. PATENT DOCUMENTS

| | | | | |
|---|---|---|---|---|
| 6,042,319 | A | 3/2000 | Hoffman | |
| 6,158,597 | A | 12/2000 | McDermott | |
| 6,182,938 | B1 | 2/2001 | Wright | |
| 6,328,519 | B1 * | 12/2001 | Nagai | 412/8 |
| 6,585,631 | B1 * | 7/2003 | Hoffman et al. | 493/476 |
| 6,632,059 | B2 * | 10/2003 | Debrunner et al. | 412/8 |
| 6,698,988 | B2 | 3/2004 | Hoffman | |
| 6,988,330 | B2 * | 1/2006 | Gavronsky | 40/107 |
| 7,156,601 | B2 * | 1/2007 | Cobene, II | 412/8 |
| 7,251,875 | B2 * | 8/2007 | Blumberg et al. | 29/509 |
| 2002/0021951 | A1 * | 2/2002 | Debrunner et al. | 412/4 |
| 2002/0164230 | A1 * | 11/2002 | Hoffman | 412/38 |

* cited by examiner

BINDING OF A SHEET OF PAPER

THIS INVENTION relates to the binding of a sheet of paper, in particular, a calendar. More particularly, this invention relates to a method of, and an apparatus for binding a sheet of paper, such as, but not limited to a calendar.

According to one aspect of the invention, there is provided a method of binding a sheet of paper which includes the steps of:

feeding an end of a sheet of paper to be bound into a partially folded elongate binding strip which defines a longitudinal axis and has two portions angularly disposed to each other, the end of the sheet of paper being fed in a feed direction that is parallel to the longitudinal axis of the binding strip into a region between the two portions; and mating the end of the sheet of paper and the binding strip, with the end of the sheet of paper located in the region between the two portions.

The method may include the step of securing the end of the sheet of paper between the two portions, by a reciprocating operation. In so doing, the binding strip may be folded and crimped. Thus, the method may include the steps of folding and crimping the binding strip.

The method may include the prior step of locating the end of the sheet of paper at an edge of the binding strip between the two portions to facilitate feeding thereof into the binding strip.

The method may include the further prior step of forming the binding strip. Thus, the method may include the steps of:

providing a length of metal workpiece;

folding the length of metal workpiece about a fold line parallel to a longitudinal axis thereof to form the two portions to be angularly disposed to each other about the fold line.

The method may be continuous or intermittent.

The method may include the further step of binding an opposed end of the sheet of paper, the opposed end being parallel to the bound end. Thus, the method may include, after the first end of the sheet of paper has been secured to a first binding strip, the steps of displacing the sheet of paper and the first binding strip secured thereto, in a direction parallel to the feed direction, and binding the opposed end of the sheet of paper with a second binding strip.

Those skilled in the art will appreciate that the length of the sheet of paper decreases when a binding strip is secured to an end thereof. The method may accommodate this in a suitable way. Thus, the method may include causing the sheet of paper to curve; or moving the sheet of paper transversely to the feed direction.

The method may also include securing the opposed end of the sheet of paper in the second binding strip by a reciprocating operation.

According to another aspect of the invention, there is provided an apparatus for binding a sheet of paper, which includes:

a feed means for feeding an end of the sheet of paper to be bound into a partially folded binding strip which defines a longitudinal axis, the folded binding strip having two portions angularly disposed to each other about a fold line, in a direction parallel to the longitudinal axis of the binding strip; and a reciprocating securing means for securing the binding strip to the end of the sheet of paper.

The securing means may fold or crimp the binding strip, in known manner.

The apparatus may include a supply means for supplying the binding strips. Conveniently, the supply means may include a hopper for the binding strips.

Instead, the apparatus may also include forming equipment for forming the binding strips from a supply of metal.

The apparatus may further include a displacement means for displacing the sheet of paper after the binding strip has been bound thereto, in a direction parallel to the feeding direction.

The apparatus may include guide means for keeping the sheet of paper in alignment during the binding process.

The apparatus may include a second feed means for feeding an opposed end of the sheet of paper into a further binding strip.

The apparatus may also include a shortening accommodating means for accommodating shortening of the sheet of paper when binding the opposed end thereof. Conveniently, the shortening accommodating means may provide a curve in the sheet of paper. Instead, the shortening accommodating means may comprise a shifting arrangement for moving the sheet of paper transversely to the feed direction. Thus, when the opposed end of the sheet of paper has been fed into the binding strip and mated therewith, the shortening accommodating means will allow the opposed end to be secured thereto whilst accommodating the decrease in length of the sheet of paper, with the already bound first end being supported without tearing of the sheet of paper.

The apparatus may further include a second displacement means for displacing the sheet of paper after the opposed end thereof has been bound. The second displacement means may include an ejectment mechanism.

As indicated above, the sheet of paper may be a calendar.

The invention will now be described by way of a non-limiting example, with reference to the accompanying diagrammatic drawings.

In the drawings

Figure 1:
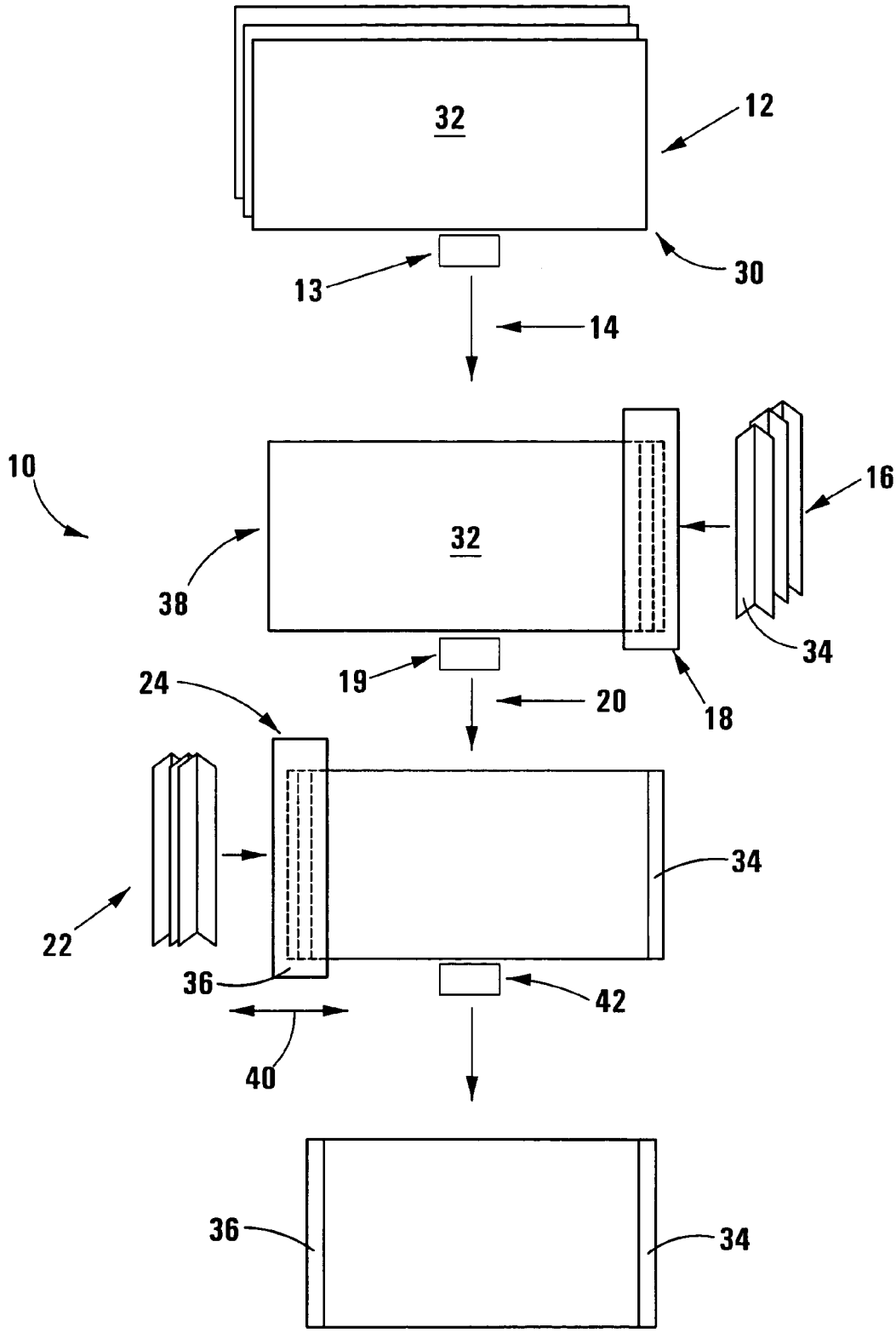
FIG. 1 is a schematic representation of an apparatus for binding a sheet of paper such as a calendar, in accordance with the invention.

Referring to the drawings, reference numeral 10 refers generally to an apparatus for binding a sheet of paper such as a calendar, in accordance with the invention. The apparatus 10 includes a station 12 for receiving a supply of sheets of paper, which in this case are calendars, a feed means 13 for feeding an end of a calendar to be bound from the station 12, a supply means 16 in the form of a hopper for supplying binding strips, and a reciprocating securing mechanism 18 for securing a binding strip to an end of a calendar. The apparatus 1 0 also includes a second feed means 19 for feeding an opposed end of a calendar whose first end has been bound, into a further binding strip provided by further supply means 22, a further securing mechanism 24 for securing the opposed end of the calendar into a further binding strip and a displacement or discharge station 42 for discharging the calendar from the apparatus 10 once both ends thereof have been bound with the binding strips.

In use, an end 30 of a calendar 32 is fed from the supply of calendars 12 into a partially folded elongate binding strip 34 having two portions angularly disposed to each other, in position, in the securing mechanism 18. The end 30 of the calendar 32 is fed by the feed means 13 into a region between the two portions in a direction shown by the arrow at 14, which direction is parallel to the longitudinal axis of the binding strip 34. The binding strip 34 is then secured to the end 30 of the calendar 32 by the securing mechanism 18. The binding strip 34, with an end portion of the calendar 32 therein, is crimped and folded, in known manner, with the result that the length of the calendar 32 is shortened. It will be appreciated that the calendar 32 will move towards the securing mechanism 18 when the binding strip 34 is secured thereto.

Once the end 30 of the calendar 32 has been secured to the binding strip 34, the calendar 32, with the binding strip 34 thereon, is fed by the second feed means 19 in the direction shown at 20 towards the further securing mechanism 24. A binding strip 36 is supplied from the supply means 22 and positioned in the securing mechanism 24 as shown such that the opposed end 38 of the calendar 32 is fed into the region between the two portions of the partially folded binding strip 36, in a direction shown by the arrow at 20. The binding strip 36 is then secured to the opposed end 38 of the calendar 32 by the securing mechanism 24 again with the result that the length of the calendar 32 with the binding strip 36 secured thereto is decreased.

The securing mechanism 24 is arranged such as to be transversely moveable in the directions shown by the arrows 40 to accommodate different lengths of calendars 32, thereby operating also as a shortening accommodating means. Thus, the calendar 32 is held stationary, with the securing mechanism 24 moving inwardly or transversely to accommodate the change in length of the calendar 32. In another embodiment of the invention, the apparatus 10 includes a dedicated shortening accommodating means which allows the calendar 32 to be moved towards the securing mechanism 24 for the binding strip 36 to be secured thereto.

Figure 2:
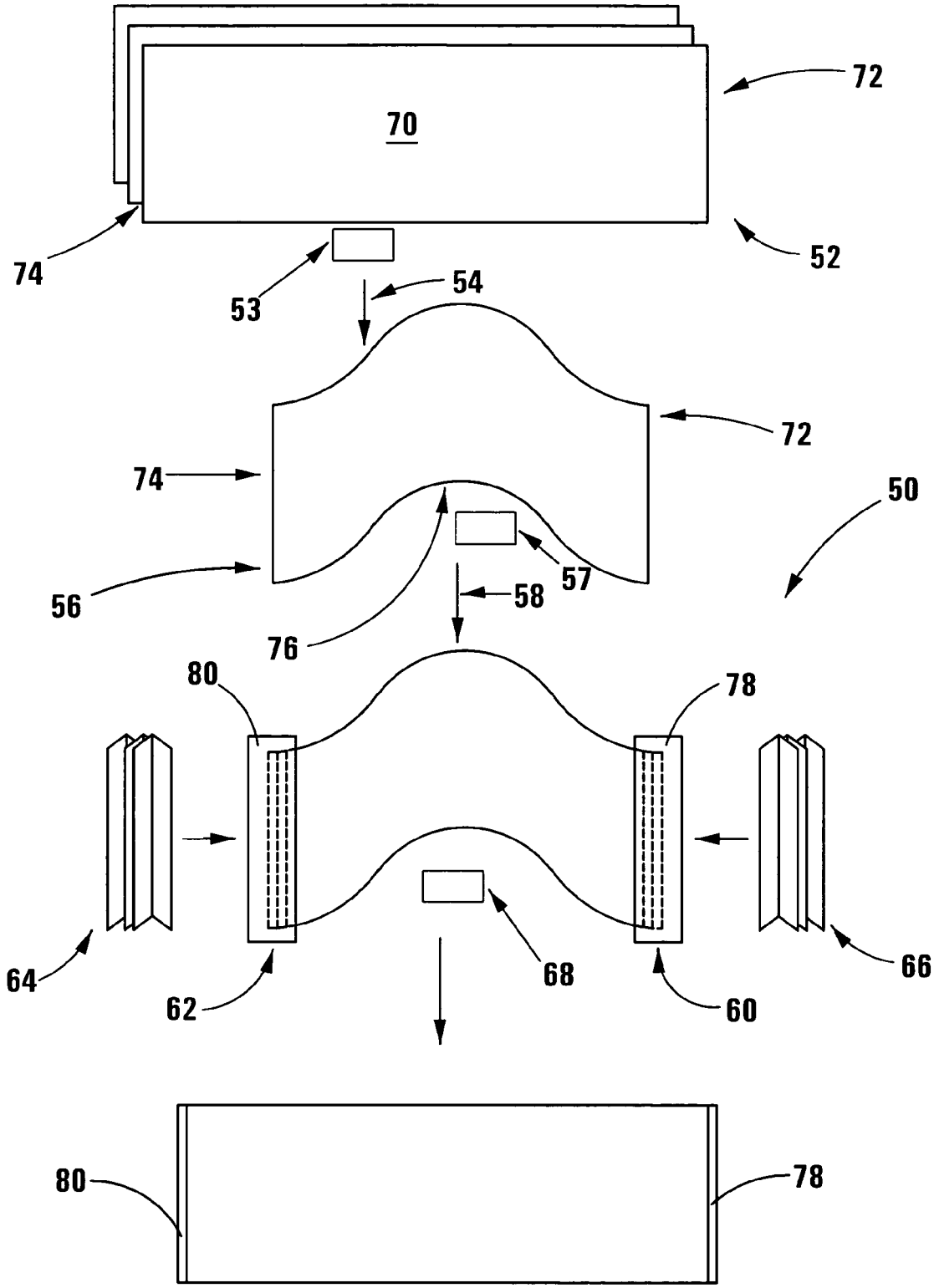
FIG. 2 is schematic representation of another embodiment of an apparatus for binding a sheet of paper such as a calendar, in accordance with the invention.

Referring to FIG. 2 of the drawings, reference numeral 50 refers generally to another embodiment of the apparatus for binding a calendar in accordance with the invention. The apparatus 50 includes a supply of calendars 52, a feed means 53 for feeding a calendar to be bound into a shortening accommodating means in the form of a looping station 56 in which a loop or curve 76 is created in the middle of the a calendar, a second feed means 57 for feeding ends of the looped or curved calendar into partially folded binding strips 78 and 80 in reciprocating securing mechanisms 60 and 62, supply hoppers 64 and 66 for supplying partially folded binding strips to the securing mechanisms 62 and 60, and a displacement or discharge station 68 for discharging a calendar which has been bound on both its ends with binding strips.

In use, a calendar 70 having opposed ends 72 and 74 is fed by the feed means 53 from the supply of calendars 52 towards the looping station 56 in the direction shown by arrow 54, wherein a loop or curve 76 is created in the calendar 70. The opposed ends 72 and 74 of the looped or curved calendar 70 are then fed by the second feed means 57 into the partially folded binding strips 78 and 80 positioned in the respective securing mechanisms 60 and 62. The binding strips 78 and 80 are then secured to the opposed ends 72 and 74 and the bound calendar 70 is discharged from the apparatus 50 by the discharge means 68. It will be appreciated by those skilled in the art, that the loop or curve 76 in the calendar 70 will decrease during the securement of the binding strips 78 and 80 to the respective opposed ends 72 and 74.

The process is continuous such that when the binding strips 78 and 80 are being bound by the respective securing mechanisms 60 and 62, a new calendar is being fed from the supply of calendars 52 into the looping station 56.

In a variation of the embodiment shown in FIG. 2, the securing mechanisms 60 and 62 may comprise moveable heads, the heads being moveable backwards and forwards relative to one another. Thus, in this embodiment, the apparatus 50 may be provided with or without the looping station 56.

Figure 3:
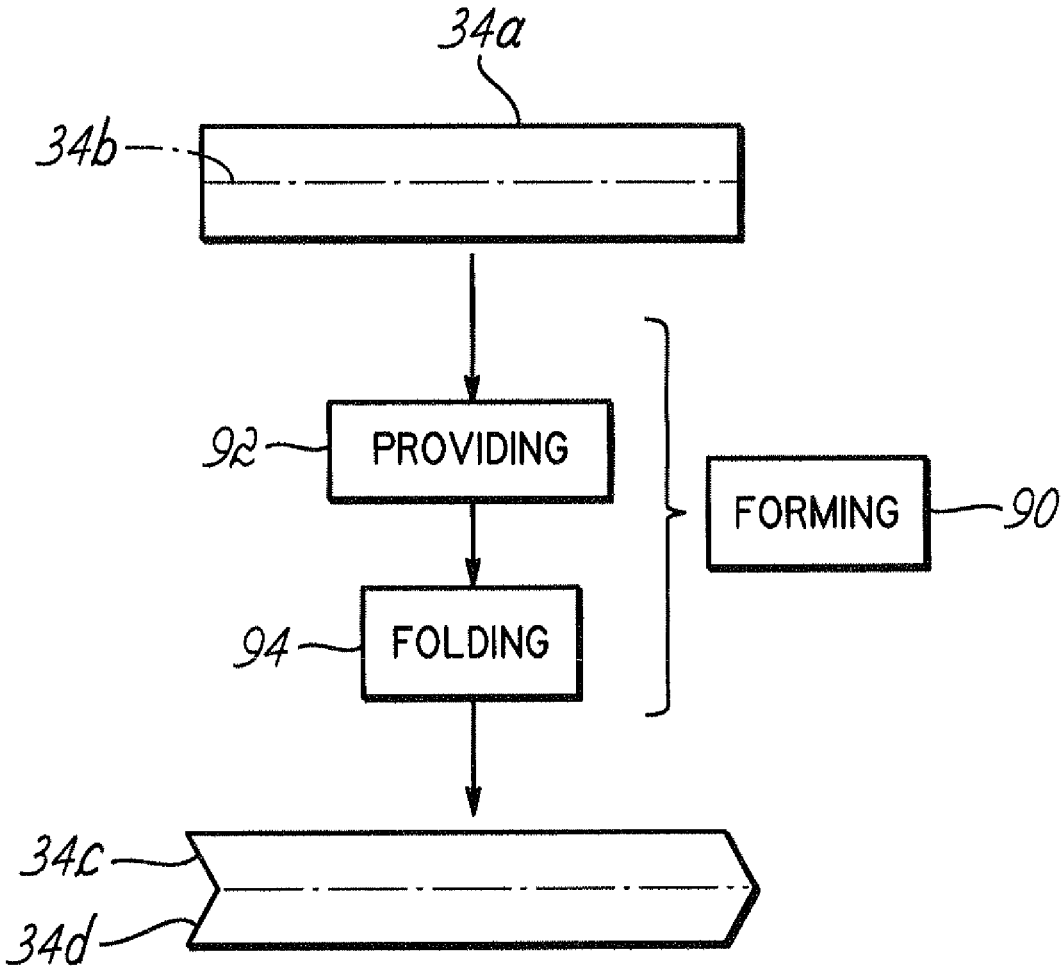
FIG. 3 is a schematic representation of a process to supply a binding strip of the embodiments of FIGS. 1 and 2.

Referring to FIG. 3, a process is schematically depicted which supplies the binding strip 34. A length of a metal workpiece 34a, which includes a folding line 34*b* that is parallel to a longitudinal axis thereof, is formed, via a forming step 90, into a binding strip 34. The binding strip 34 is partially folded along folding line 34*b* and includes two portions 34*c*, 34*d* angularly disposed to one another. The forming step 90 may, for example, include the steps of providing the length of metal workpiece (step labeled with numeral 92) and folding the same (step labeled with numeral 94) about the folding line 34*b*.

The invention claimed is:

1. A method of binding a sheet of paper which includes the steps of: feeding an end of a sheet of paper to be bound into a partially folded elongated binding strip having two portions angularly disposed to each other from a fold line defining a longitudinal axis, wherein the direction of feeding of the sheet of paper is parallel to the longitudinal axis of the binding strip; mating the end of the sheet of paper and the binding strip, with the end of the sheet of paper located in the region between the two portions; crimping the binding strip with the end of the sheet of paper therein; and folding the binding strip with the end of the sheet of paper therein.

2. A method as claimed in claim 1, which includes the step of securing the end of the sheet of paper between the two portions, by a reciprocating operation.

3. A method as claimed in claim 1, which includes the prior step of locating the end of the sheet of paper at an edge of the binding strip between the two portions to facilitate feeding thereof into the binding strip.

4. A method as claimed in claim 1, which includes the prior step of forming the binding strip.

5. A method as claimed in claim 4, which includes the steps of:

providing a length of metal workpiece;

folding the length of metal workpiece about a fold line parallel to a longitudinal axis thereof to form the two portions to be angularly disposed to each other about the fold line.

6. A method as claimed in claim 1, which includes the further step of binding an opposed end of the sheet of paper, the opposed end being parallel to the bound end.

7. A method as claimed in claim 6, which includes, after the first end of the sheet of paper has been secured to a first binding strip, the steps of displacing the sheet of paper and the first binding strip secured thereto, in a direction parallel to the feed direction, and binding the opposed end of the sheet of paper with a second binding strip.

8. A method as claimed in claim 6, which includes causing the sheet of paper to curve.

9. A method as claimed in claim 6, which includes moving the sheet of paper transversely to the feed direction.

10. A method as claimed in claim 6, which includes securing the opposed end of the sheet of paper in the second binding strip by a reciprocating operation.

11. The method of claim 1 further comprising:

shortening a length of the sheet of paper.

12. An apparatus for binding a sheet of paper comprising:

a feed means for feeding an end of the sheet of paper to be bound into a partially folded binding strip having a longitudinal axis, wherein the binding strip has two portions angularly disposed to each other extending from a fold line defining said longitudinal axis; and a reciprocating securing means for securing the binding strip to the end of the sheet of paper;

wherein the feed means directs the end of the sheet of paper into a region between the two portions angularly disposed to each other of the binding strip in a direction parallel to said longitudinal axis prior to securing the binding strip to the end of the sheet of paper with the reciprocating securing means.

13. An apparatus as claimed in claim 12, in which the securing means folds or crimps the binding strip.

14. An apparatus a claimed in claim 12, which includes a supply means for supplying the binding strips.

15. An apparatus as claimed in claim 12, which includes forming equipment for forming the binding strips from a supply of metal.

16. An apparatus as claimed in claim 12, which further includes a displacement means for displacing the sheet of paper after the binding strip has been bound thereto, in a direction parallel to the feeding direction.

17. An apparatus as claimed in claim 12, which includes a second feed means for feeding an opposed end of the sheet of paper into a further binding strip.

18. An apparatus as claimed in claim 17, which includes a shortening accommodating means for accommodating shortening of the sheet of paper when binding the opposed end thereof.

19. An apparatus as claimed in claim 18, in which the shortening accommodating means provides a curve in the sheet of paper.

20. An apparatus as claimed in claims 18, in which the shortening accommodating means comprises a shifting arrangement for moving the sheet of paper transversely to the feed direction.

21. An apparatus as claimed in claim 20, which further includes a second displacement means for displacing the sheet of paper after the opposed end thereof has been bound.

22. An apparatus as claimed in claim 21, in which the second displacement means includes an ejectment mechanism.

23. An apparatus as claimed in claim 22, for binding a sheet of paper which is a calendar.

* * * * *